US007142172B2

(12) United States Patent
Lee

(10) Patent No.: US 7,142,172 B2
(45) Date of Patent: Nov. 28, 2006

(54) ANTENNA REFLECTION STRUCTURE

(75) Inventor: Chang-Jung Lee, Longtan Township, Taoyuan County (TW)

(73) Assignee: Accton Technology Corporation, Hsinchu (TW)

( * ) Notice: Subject to any disclaimer, the term of this patent is extended or adjusted under 35 U.S.C. 154(b) by 212 days.

(21) Appl. No.: 10/920,075

(22) Filed: Aug. 17, 2004

(65) Prior Publication Data

US 2005/0068242 A1 Mar. 31, 2005

(30) Foreign Application Priority Data

Sep. 30, 2003 (TW) ..... 92217568 U

(51) Int. Cl.
*H01Q 15/14* (2006.01)

(52) U.S. Cl. ..... 343/912

(58) Field of Classification Search ..... 343/781 R, 343/781 P, 878, 912, 914, 916
See application file for complete search history.

(56) References Cited

U.S. PATENT DOCUMENTS 5,278,571 A * 1/1994 Helfrick ..... 343/703
5,423,072 A * 6/1995 Iwashita et al. ..... 455/67.14
6,556,174 B1 * 4/2003 Hamman et al. ..... 343/755
2004/0056818 A1 * 3/2004 Sledkov ..... 343/797

FOREIGN PATENT DOCUMENTS

| | | | |
|---|---|---|---|
| EP | 1 193 794 | A2 * | 4/2002 |
| EP | 1193794 | * | 4/2002 |
| EP | 1193794 | A2 | 4/2002 |
| EP | 1 227 538 | A1 * | 7/2002 |
| EP | 1227538 | * | 7/2002 |
| EP | 1227538 | A1 | 7/2002 |
| WO | WO 98/36472 | | 8/1998 |

* cited by examiner

*Primary Examiner*—Tan Ho
*Assistant Examiner*—Leith Al-Nazer
(74) *Attorney, Agent, or Firm*—Thomas, Kayden, Morstemeyer & Risley

(57) ABSTRACT

An antenna reflection structure including a plate, a side wall and a protrusion is disclosed. The side wall is generally perpendicular to the plate and the protrusion respectively. And a concave slot is formed by the side wall, the plate and the protrusion. The antenna can be fixed on the plate. The concave slot controls the transmitting direction of the electromagnetic waves transmitted from the antenna so that multi-reflection of the electromagnetic waves in the concave slot occurs and the electromagnetic waves can be transmitted in a desired single direction with the aid of the protrusion. Therefore, the antenna reflection structure can yield higher gain value and better directivity. In addition, the antenna reflection structure further provides the characteristics of being easy to process and minimize.

13 Claims, 10 Drawing Sheets

ANTENNA REFLECTION STRUCTURE

This application claims the benefit of Taiwan application Serial No. 92217568, filed Sep. 30, 2003, the subject matter of which is incorporated herein by reference.

BACKGROUND OF THE INVENTION

1. Field of the Invention

The present invention relates to an antenna reflection structure, and more particularly, to an antenna reflection structure having a concave slot.

2. Description of the Related Art

In general, an antenna reflection structure is mainly used to reflect and guide electromagnetic waves from an antenna to transmit in a desired direction. To achieve this goal, conventionally, spherical surface, paraboloid or other special curved surface is adopted as the reflecting surface of the antenna reflection structure. Thus, after the antenna sends out the electromagnetic waves from the focal of the curved surface, the curve surface reflects electromagnetic wave to transmit in a desired direction. Therefore, the directivity and the gain value of the antenna are enhanced.

SUMMARY OF THE INVENTION

Most of the conventional antenna reflection structures are spherical, paraboloid or other special curved surface. For controlling the position of the focal point precisely and maintaining equal curvature of each part of the curved surface, the manufacture of the curved surface becomes very difficult, and more often, the cost is raised. In addition, the antenna reflection structure with this type of curved surface is hard to be minimized in size due to the difficulty in manufacturing. It is therefore an object of the invention to provide an antenna reflection structure with simple manufacturing process and effective reflecting result.

Accordingly, it is an objective of the present invention to provide an antenna reflection structure for reflecting electromagnetic wave emitted from an antenna. There is provided an antenna reflection structure comprising: a plate, a side wall and a protrusion. The side wall joins to the rim of the plate and surrounds the plate. The protrusion joins to the side wall and surrounds the rim of the side wall. The protrusion extends out from side wall and is substantially perpendicular to the plate, and the side wall is substantially perpendicular to the plate and protrusion. Accordingly, a concave slot is formed by the plate, the side wall and the protrusion. By the way of several reflection of electromagnetic wave emitted from antenna to the concave slot, and transmit towards the opening direction of the concave slot, the higher gain value and the directivity are obtained. Moreover, the antenna reflection structure also provides the some characteristics such as simple manufacturing, good directivity and easy minifying.

The following are some functions and outcomes based on the antenna reflection structure of the present invention: 1. the antenna reflection structure according to the present invention is formed by the plate, herein the easy manufacturing and the low cost characteristics are provided; 2. according to the antenna reflection structure of the present invention, the higher gain value, directivity and better communication quality are obtained; and 3 the antenna reflection structure of the present invention is easy to have a minified design due to its uncomplicated form.

The objects, and functions of the invention will become more apparent from the following detailed description. The following description is made with reference to the accompanying drawings.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
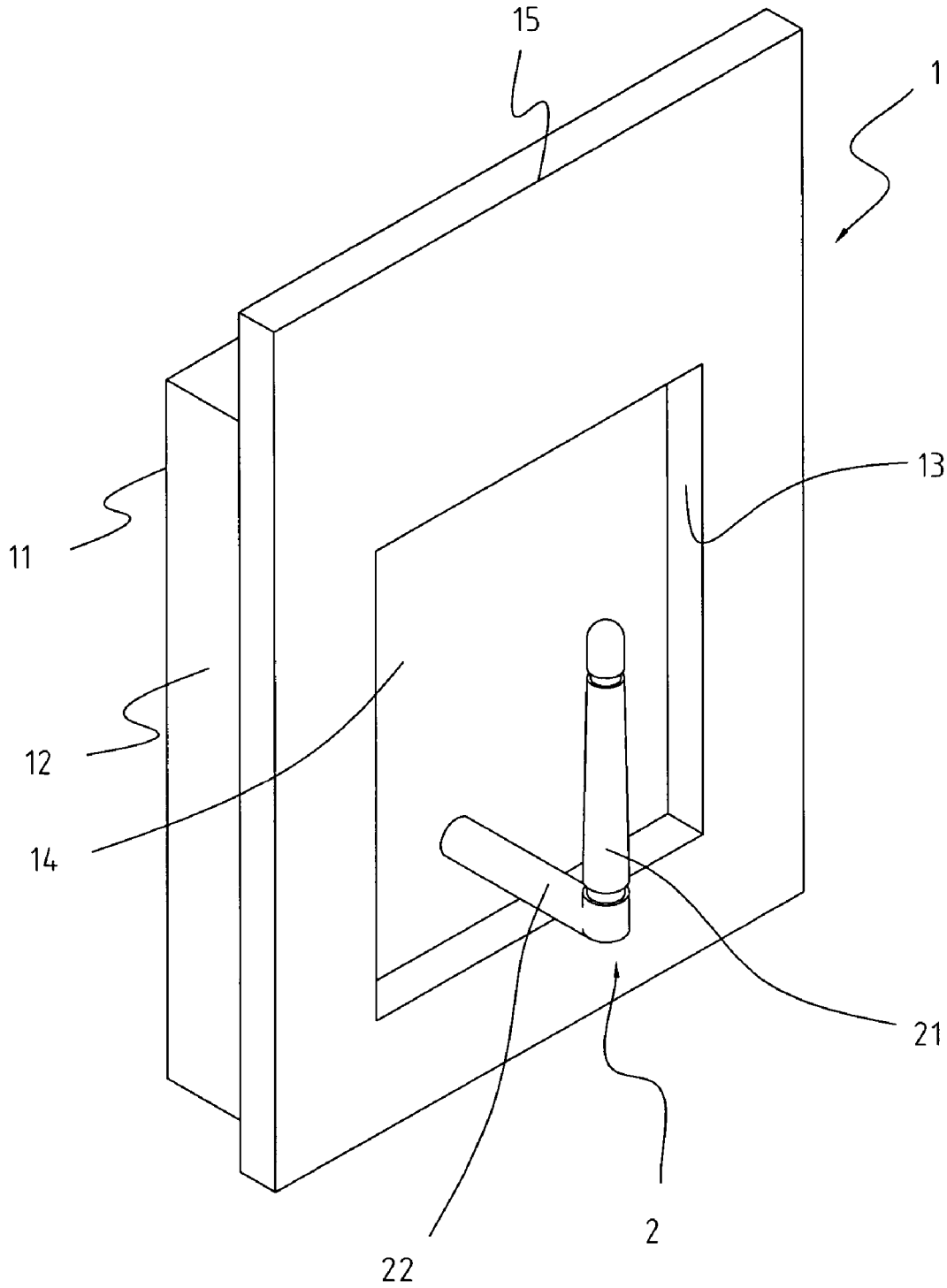
FIG. 1 is a three dimensional view of an antenna reflection structure according to a preferred embodiment of the present invention.
Figure 2:
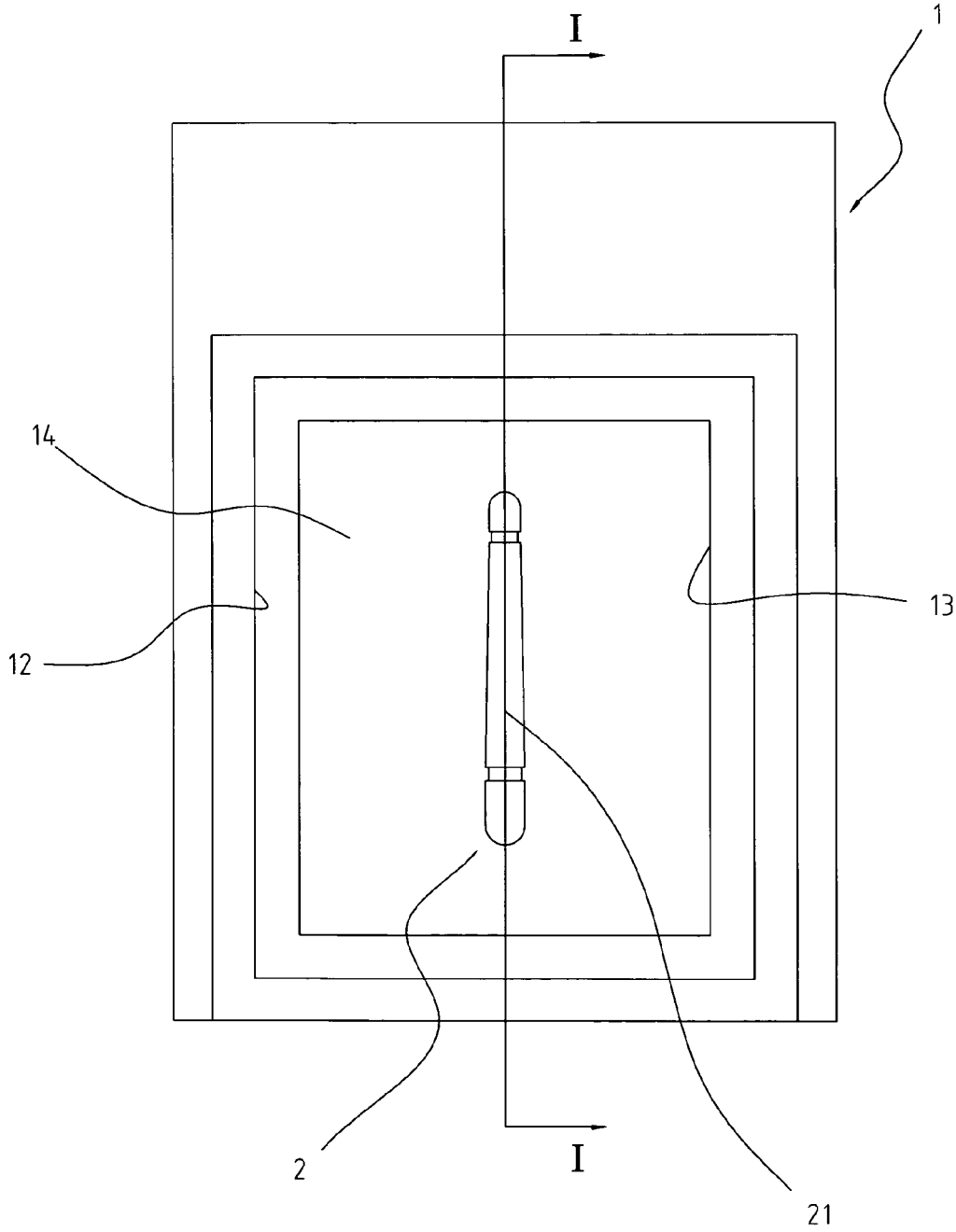
FIG. 2 is a front view of an antenna reflection structure according to a preferred embodiment of the present invention.
Figure 3:
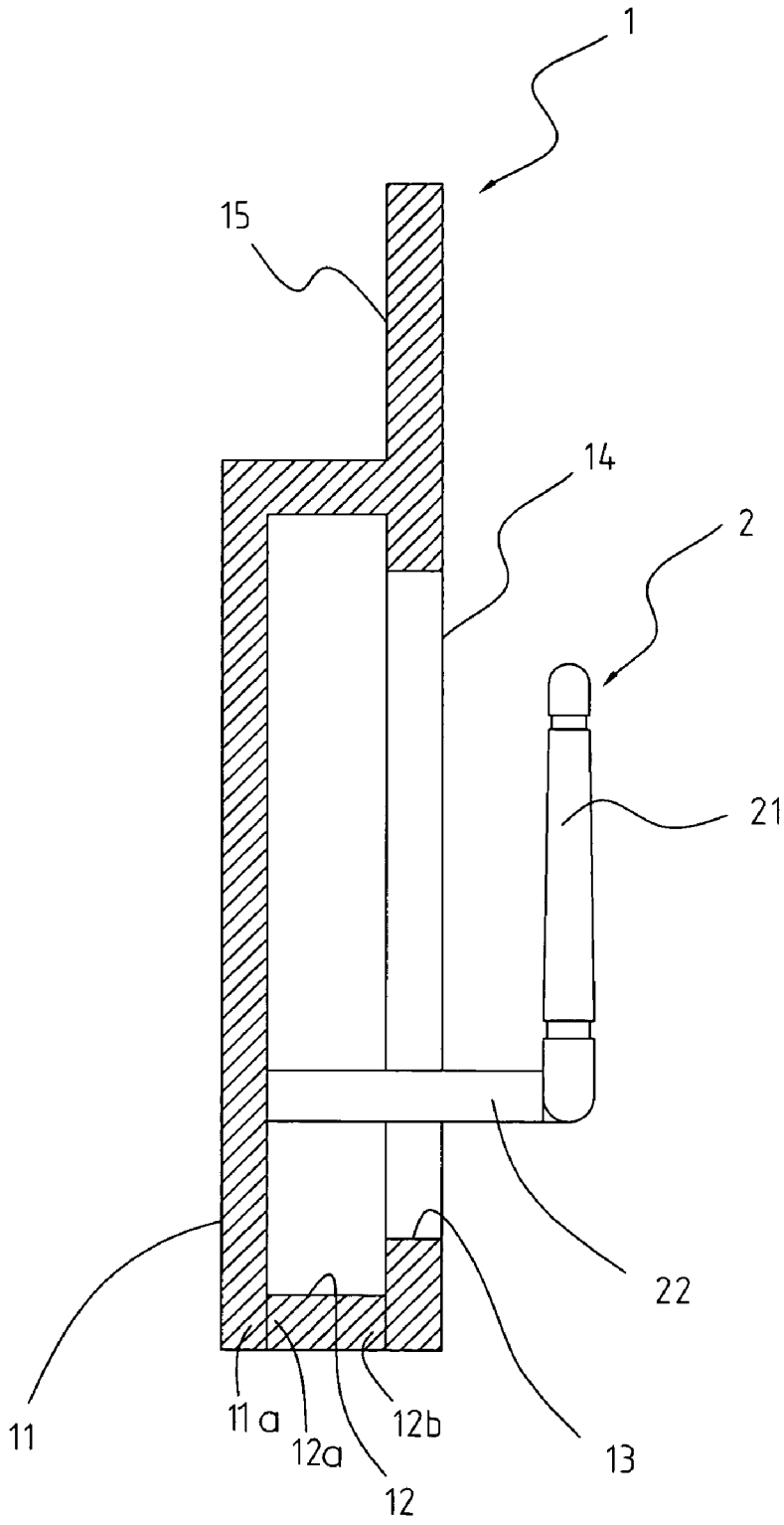
FIG. 3 shows the I—I cross-sectional view of the antenna reflection structure as shown in FIG. 2.

FIG. 1 is a three-dimensional view of an antenna reflection structure according to a preferred embodiment of the present invention. FIG. 2 is a front view of an antenna reflection structure according to a preferred embodiment of the present invention. FIG. 3 shows the cross-sectional view of the I—I cross section of the antenna reflection structure as shown in FIG. 2. As illustrated in the foregoing drawings, the antenna reflection structure includes a plate 11, a side wall 12 and a protrusion 13. One side 12*a* of the side wall 12 joins to the rim 11*a* of the plate 11 and surrounds the plate 11, while the protrusion 13 joins to the other side 12*b* of the side wall 12 and surrounds the side wall 12. The protrusion 13 extends out from the side wall 12 and is substantially parallel to the plate 11. Besides, the side wall 12 is substantially perpendicular to the plate 11 and protrusion 13; therefore, the plate 11, the side wall 12 and the protrusion 13 could form a concave slot 14 for containing the antenna 2.

The direction of electromagnetic wave emitted from the antenna can be limited by the concave slot 14. Electromagnetic wave perpendicularly transmitted to the plate 11 will be directly reflected out from the concave slot 14. Electromagnetic wave transmitted to the plate 11 in a direction other than perpendicular to the plate 11 and electromagnetic wave transmitted to other parts of the concave slot 14, such as side wall 12, will finally be reflected out of the concave slot 14 substantially in a single direction with the aid of the protrusion 13. The protrusion 13 acts to limit the direction of the electromagnetic wave. The protrusion 13 blocks the diversely distributed electromagnetic wave and makes the electromagnetic wave reflected back to the concave slot 14 and finally transmitted out of the concave slot 14 in a single direction. Therefore, most electromagnetic wave was transmitted in a single direction, namely through the opening end of the concave slot 14. That is mainly because the multi-reflection of the diversely distributed electromagnetic wave in the concave slot 14. Therefore, the directivity and the gain value of the antenna are enhanced.

The preferred material for the plate 11, the side wall 12, and the protrusion 13 can be metal or other material capable of reflecting electromagnetic wave. Also, the plate 11, the side wall 12 and the protrusion 13 can be independent units and assembled to form the concave slot 14. Preferably, the plate 11, the side wall 12 and the protrusion 13 are formed as an integral, by ways of sheet metal, founding or power metallurgy.

Moreover, the shape of the plate 11 can be rectangular, circular, or elliptical but is not limited thereto. Any shape of the plate 11 capable of generating the expected shapes of the radiation fields can be used. Besides, the panel 15 can be disposed on the side wall 12 for fixing the antenna reflection structure 1 onto the other structures.

Referring to FIG. 2 and FIG. 3, the antenna 2 can be disposed on the plate 11 directly. The antenna 2 can be an omnidirectional antenna which enables part of electromagnetic wave to transmit to the concave slot 14. The antenna 2 is preferably a sleeve antenna and the connecting base 22 of the antenna 2 is fixed onto one site of the plate 11 so that the radiation component 21 of the sleeve antenna 2 is substantially located at the center of the plate. Thus, a better radiation field can be generated. However, the types of antenna 2 are not limited thereto. Other types of omnidirectional or directional antennas could also be used. can be generated. However, the types of antenna 2 are not limited thereto. Other types of omnidirectional or directional antennas could also be used.

Figure 4:
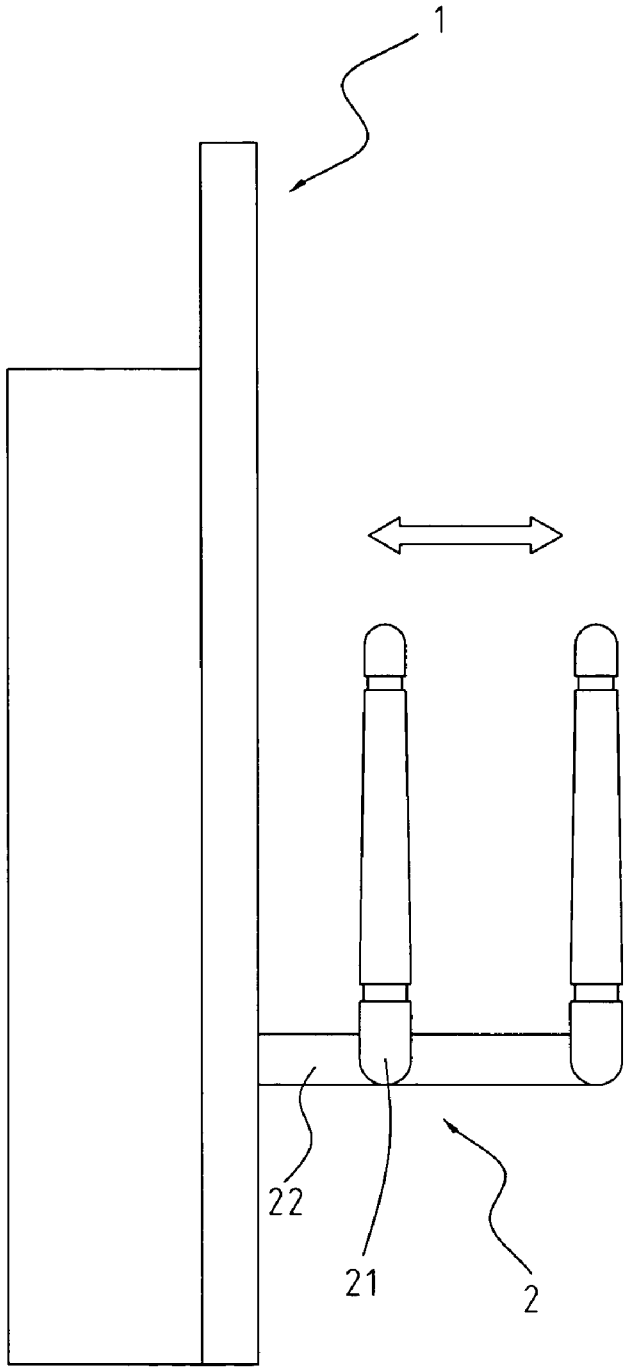
FIG. 4 is a side view of the antenna reflection structure according to a preferred embodiment of the present invention.

Moreover, as shown in the FIG. 4, the radiation field generated by the antenna 2 can be controlled by adjusting the relative position of the antenna 2 and the antenna reflection structure 1 to tune the angle of the electromagnetic waves emitted into the concave slot 14.

Figure 5A:
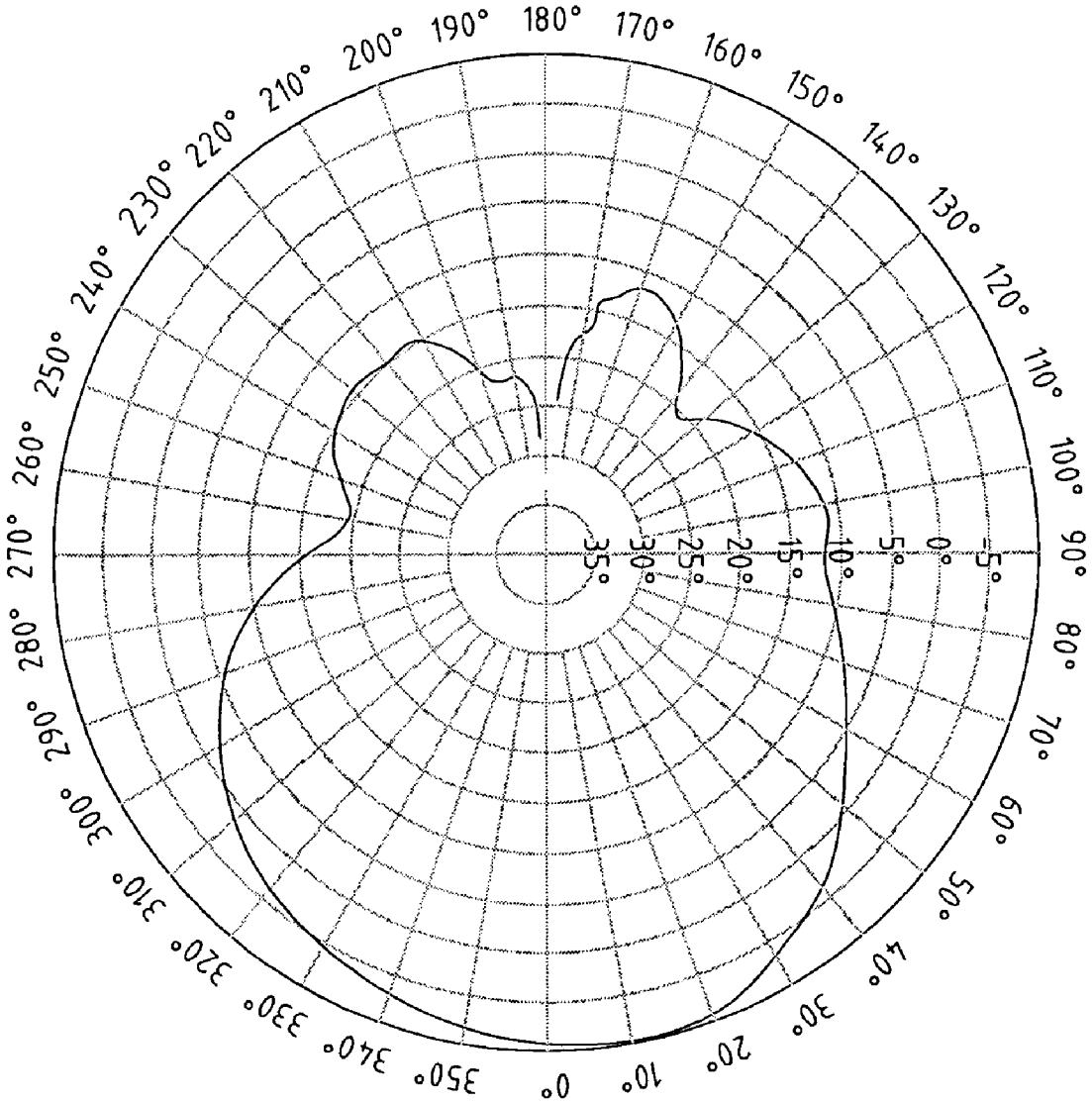
FIGS. 5(*a*) and 5(*b*) show the field shapes of E-plane and H-plane of the antenna reflection structure coupled with sleeve antenna at 2.4 GHz according to the present invention.
Figure 5B:
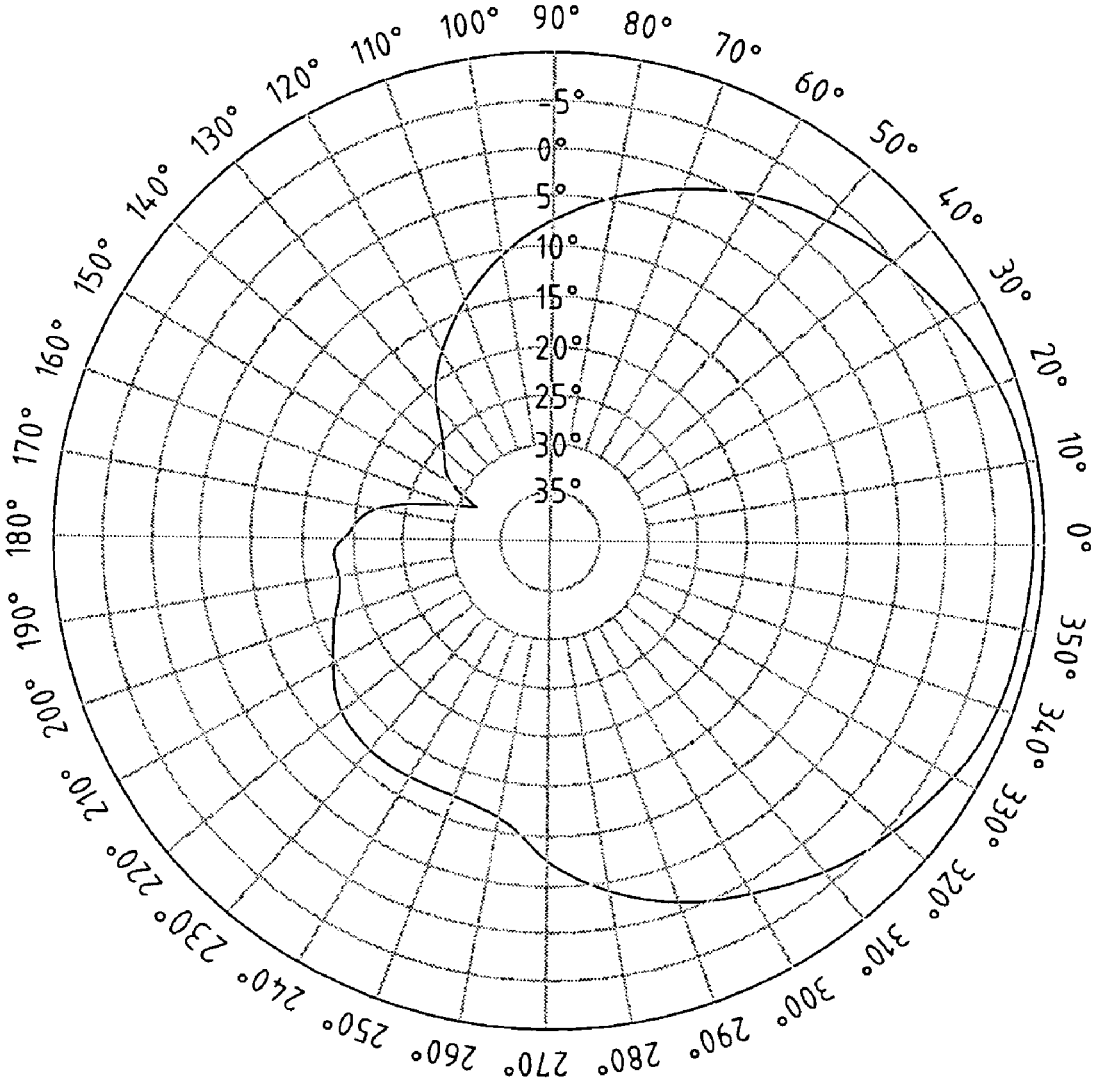

FIG. 5(*a*) and FIG. 5 (*b*) show the resulting field shapes of E-plane and H-plane at 2.4 GHz respectively, while the antenna 2 is a sleeve antenna. In the field shape distribution of the E-plane, the maximum gain value is 9.07 dBi at 8°, and the minimum gain value is −33.13 dBi at 179°, while the average gain value is 1.28 dBi. In the field shape distribution of the H-plane, the maximum gain value is 8.80 dBi at 358°, and the minimum gain value is −33.11 dBi at 157°, while the average gain value is 2.20 dBi.

Figure 6A:
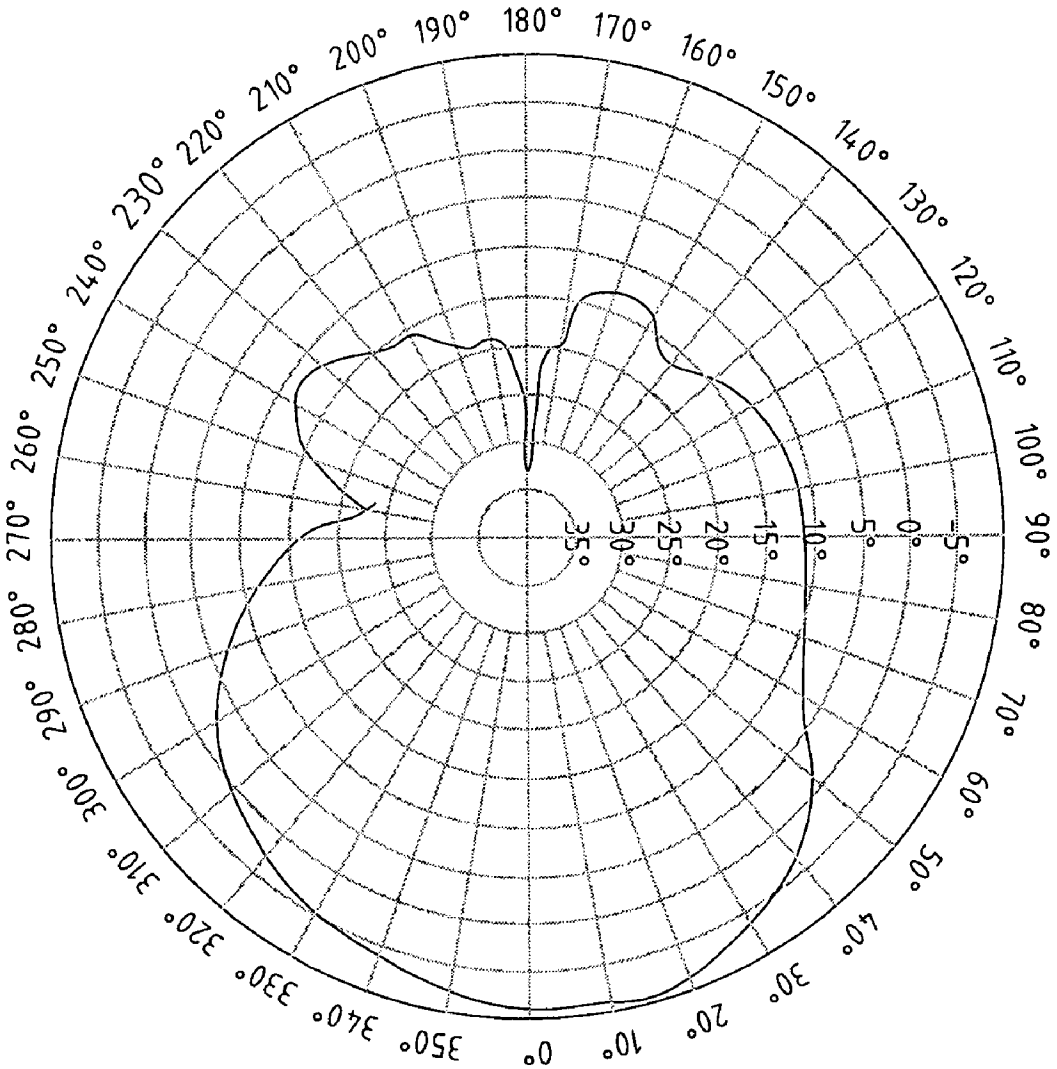
FIGS. 6(*a*) and 6(*b*) show the field shapes of E-plane and H-plane of the antenna reflection structure coupled with the sleeve antenna at 2.45 GHz according to the present invention.
Figure 6B:
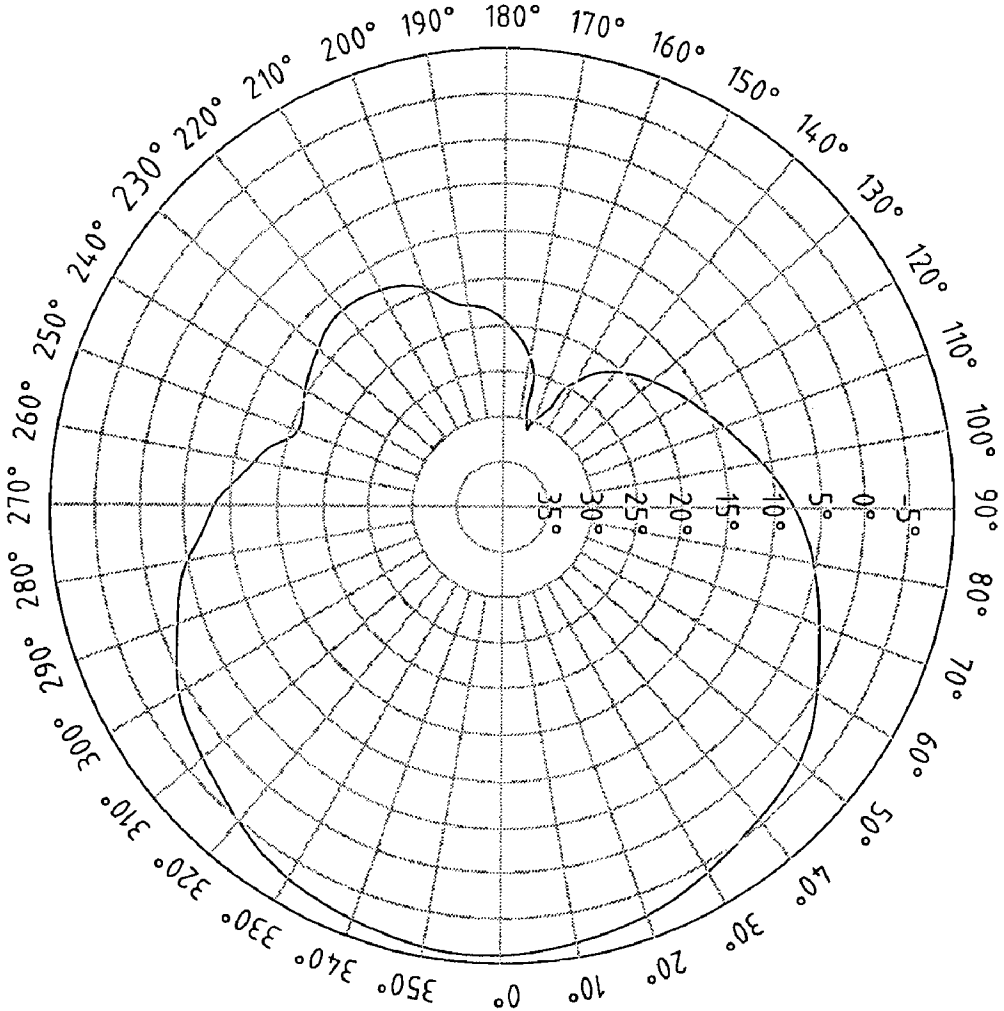

FIG. 6(*a*) and FIG. 6 (*b*) show resulting field shapes of E-plane and H-plane at 2.45 GHz respectively, while the antenna 2 is a sleeve antenna. In the field shape distribution of the E-plane, the maximum gain value is 8.67 dBi at 7°, and the minimum gain value is −32.76 dBi at 176°, while the average gain value is 0.73 dBi. In field shape distribution of the H-plane field, the maximum gain value is 8.32 dBi at 1°, and the minimum gain value is −31.31 dBi at 161° while the average gain value is 1.67 dBi.

Figure 7A:
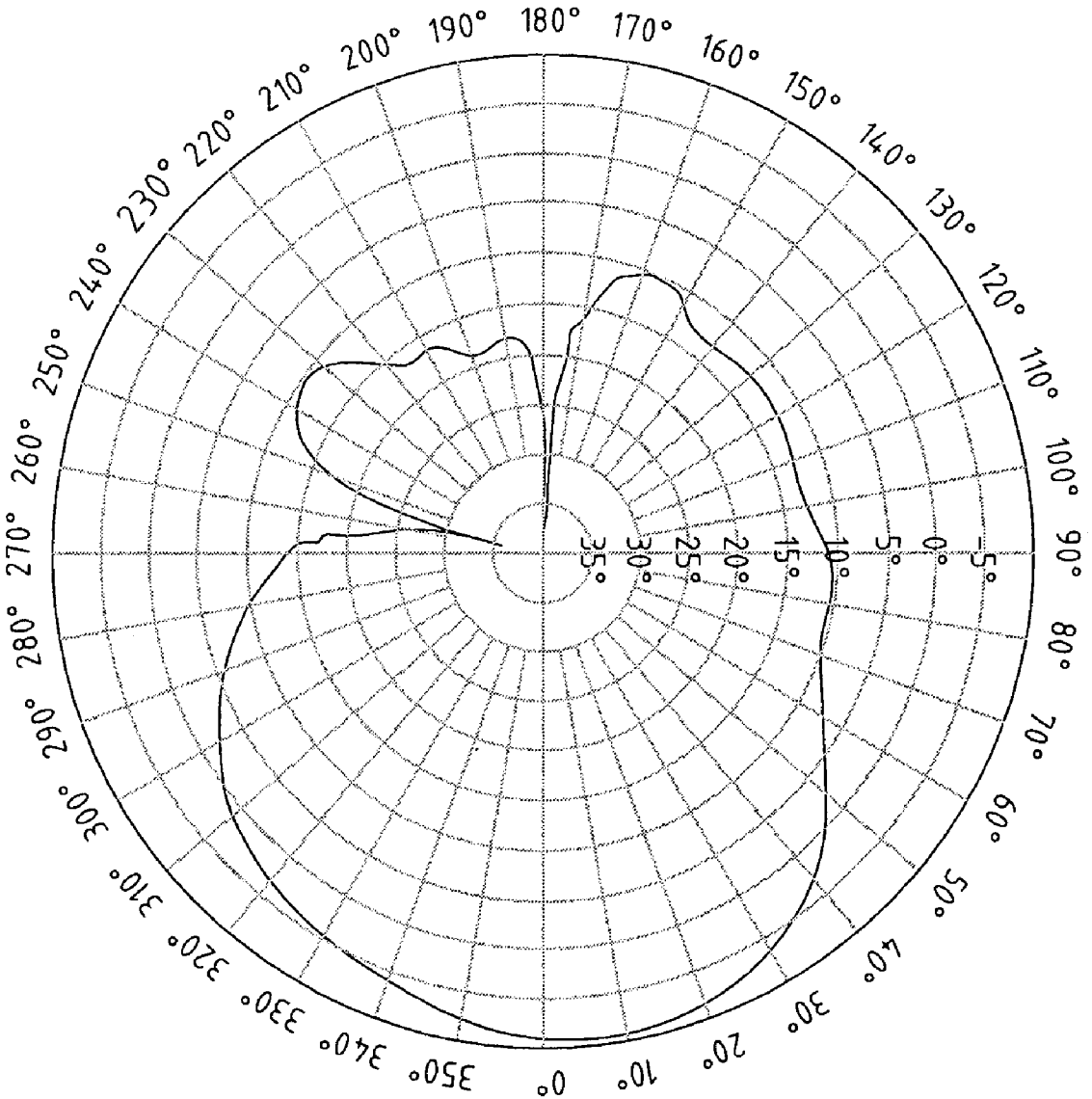
FIGS. 7(*a*) and 7(*b*) show the field shape of E-plane and H-plane of the antenna reflection structure coupled with the sleeve antenna at 2.5 GHz according to the present invention.
Figure 7B:
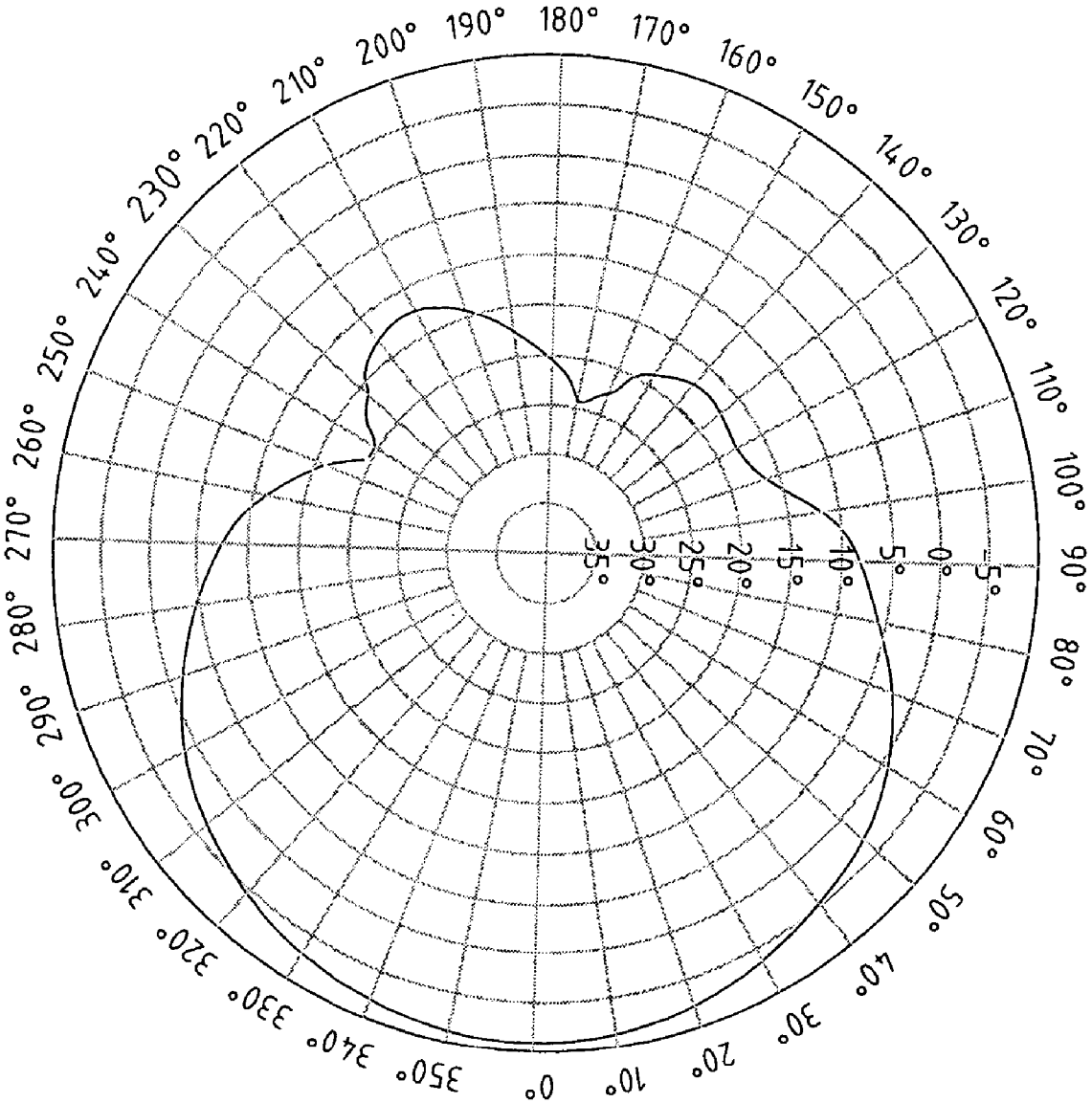

FIG. 7(*a*) and FIG. 7(*b*) show the resulting field shapes of E-plane and H-plane at 2.5 GHz respectively, while the antenna 2 *e* is a sleeve antenna. In the field shape distribution of the E-plane, the maximum gain value is 9.01 dBi at 7°, and the minimum gain value is −41.54 dBi at 178°, while the average gain value is 1.01 dBi. In field shape distribution of the H-plane, the maximum gain value is 8.64 dBi at 1°, and the minimum gain value is −24.48 dBi at 167° while the average gain value is 1.95 dBi. Therefore, it is known by the FIGS. 5~7, the higher gain value and better directivity are obtained at 2.4~2.5 GHz according to the antenna reflection structure of the present invention.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna reflection structure for reflecting electromagnetic wave emitted by an antenna comprising:

a plate with a rim;

a side wall with a rim, the side wall extending from the rim of the plate and being substantially perpendicular to the plate; and a protrusion, which extends from the rim of the side wall and is parallel to the plate and is substantially perpendicular to the side wall, wherein the protrusion, the plate and the side wall form a concave slot to contain the antenna and reflect the electromagnetic waves from the antenna, wherein one end of the antenna is received in the concave slot and the other end of the antenna projects outside the antenna reflection structure.

2. The antenna reflection structure as claimed in claim 1, wherein the plate, the side wall and the protrusion are made of metal.

3. The antenna reflection structure as claimed in claim 1, wherein the plate, the side wall and the protrusion are formed as an integral.

4. The antenna reflection structure as claimed in claim 1, wherein the plate is rectangular.

5. The antenna reflection structure as claimed in claim 1, wherein the plate is circular.

6. The antenna reflection structure as claimed in claim 1 further comprising a panel connected to the side wall for fixing the antenna reflection structure.

7. The antenna reflection structure as claimed in claim 1, wherein the antenna is fixed on the plate.

8. The antenna reflection structure as claimed in claim 1, wherein the antenna is an omnidirectional antenna.

9. The antenna reflection structure as claimed in claim 8, wherein the antenna is a sleeve antenna.

10. The antenna reflection structure as claimed in claim 1, wherein the antenna is a directional antenna.

11. The antenna reflection structure as claimed in claim 1, wherein the antenna includes a connecting base and a radiation component, and the connecting base connects the radiation component onto the plate.

12. The antenna reflection structure as claimed in claim 11, wherein the radiation component is outside the antenna reflection structure and substantially located at the center of the plate.

13. The antenna reflection structure as claimed in claim 12, wherein the radiation component is parallel to the plate.

* * * * *